United States Patent [19]

Seymour et al.

[11] Patent Number: 4,609,898

[45] Date of Patent: Sep. 2, 1986

[54] MOLDED CASE CIRCUIT BREAKER HAVING A THERMOPLASTIC COVER

[75] Inventors: Raymond K. Seymour, Plainville; Roger J. Morgan, Simsbury; Stephen F. Gillette, Rocky Hill, all of Conn.

[73] Assignee: General Electric Company, New York, N.Y.

[21] Appl. No.: 751,917

[22] Filed: Jul. 5, 1985

[51] Int. Cl.[4] ..... H01H 9/02; H01H 13/04

[52] U.S. Cl. ..... 335/202; 200/293; 174/50

[58] Field of Search ..... 335/202; 200/144 C, 200/149 A, 293; 220/12, 14, 4 B; 174/50; 361/272

[56] References Cited

U.S. PATENT DOCUMENTS

| | | | |
|---|---|---|---|
| 2,674,646 | 4/1954 | Schoch | 361/272 |
| 2,904,618 | 9/1959 | Robinson | 361/272 |
| 4,513,268 | 4/1985 | Seymour et al. | 335/35 |

*Primary Examiner*—E. A. Goldberg
*Assistant Examiner*—Lincoln Donovan
*Attorney, Agent, or Firm*—Richard A. Menelly; Walter C. Bernkopf; Fred Jacob

[57] ABSTRACT

A residential circuit breaker design provides heat sink facility to the current carrying members within a thermoset plastic base. A thermoplastic plastic cover is ribbed internally to minimize contact between the interior of the cover and current carrying components. The thermoplastic cover results in a substantial savings in material costs since the thermoplastic waste material is recoverable and re-useable.

7 Claims, 4 Drawing Figures

MOLDED CASE CIRCUIT BREAKER HAVING A THERMOPLASTIC COVER

BACKGROUND OF THE INVENTION

U.S. Pat. No. 4,513,268 to R. K. Seymour et al. describes an automated Q-line circuit breaker wherein the case is provided with a plurality of ridges and grooves for facilitating robotic assembly of the circuit breaker components. It is heretofore been customary to use a thermoset plastic material for both the circuit breaker case as well as the circuit breaker cover. The thermoset material is stable at the high operating currents which occur during limited exposure to overcurrent conditions. Since the calibration of the thermal and magnetic trip unit is critical, it is an important requirement that the components within the circuit breaker case remain in their exact locations in order to maintain calibration. The cover which is attached to the base, generally contains ribbed extensions for assisting in positioning the internal circuit breaker components in the base which must also remain intact after exposure to overcurrent and overtemperature conditions. The cover therefore has also been fabricated from a thermoset-type plastic material in order to avoid thermal distortion.

The main source of heat generated within a circuit breaker enclosure consisting of the cover and base, comprises the bimetal trip unit which is intended to become heated in proportion to the current transported through the breaker. When the breaker is subjected to two hundred percent normal operating current conditions, the temperature of the bimetal can exceed one hundred degrees centigrade. The components electrically connected with the bimetal also become heated by thermal conduction since good conductors of electricity are generally good conductors of heat. The end of the line strap is secured to one end of the bimetal and one end of the braid conductor is attached to the opposite end of the bimetal. The load strap and the braid conductor transfer heat away from the bimetal out to the load terminal and to the movable contact arm accordingly. To facilitate aligning the contact arm and guiding its motion between closed and open positions, a rib guide is formed on the internal surface of the cover. To facilitate the automation process, the braid in the automated Q-line breaker described within the referenced Patent is first installed in the case and the cradle is then positioned over the braid. It has since been discovered that the arrangement of a pair of support ridges within the case for holding the load strap and the rib guide on the cover for guiding the contact arm also function to reduce the temperature to which the cover becomes subjected upon overload test conditions. This reduction in temperature to which the cover becomes subjected has led to the use of a thermoplastic material as a substitute for the thermoset material usually employed.

The purpose of the instant invention therefore is to provide a residential-type circuit breaker case and component arrangement which allows for substitution of a thermoplastic plastic material for the cover in place of the usual thermoset plastic.

SUMMARY OF THE INVENTION

The provision of a plurality of ridges and grooves integrally formed within a thermoset plastic base and the arrangement of the braid conductor and bimetal away from the cover allows the cover to be fabricated from a thermoplastic material without distortion and without effecting the breaker calibration.

DESCRIPTION OF THE PREFERRED EMBODIMENT

Figure 1:
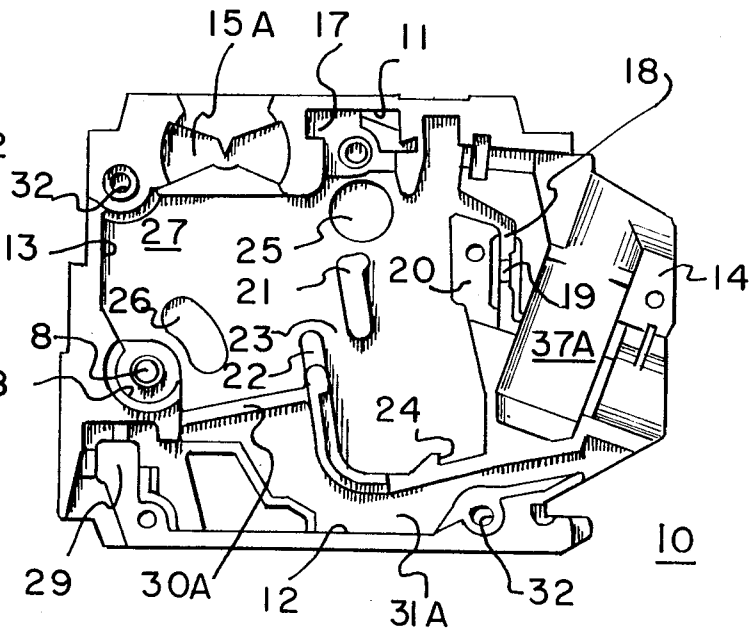
FIG. 1 is a plan view of a thermoset molded plastic case according to the invention.
Figure 2:
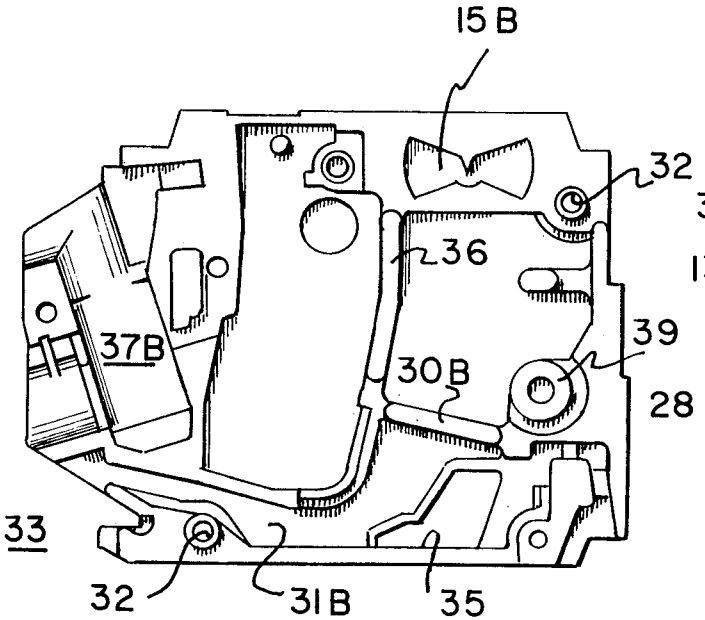
FIG. 2 is a plan view of a molded thermoplastic cover for use with the base depicted in FIG. 1.

FIG. 1 contains a case 10 similar to that described within the aforementioned U.S. patent and consisting of an integrally formed top rail 11, bottom rail 12 and front and rear rails 13, 14 formed from a theromset material such as a 45% glass-filled polyester. This material is selected to provide good heat withstanding properties in order not to be distorted by the circuit breaker component parts upon overload current conditions. Also formed at the top portion of the case is a latch spring slot 17 above and to the left of a trip assembly and load strap slot 18 bounded by a right barrier 19 and a left barrier 20 as indicated. A top barrier 21 and bottom barrier 22 define the braid and contact blade slot 23 with a magnet stop 24 integrally formed at the bottom and a depression 25 for housing a common trip pivot assembly. A depression 26 is formed in the bottom surface 27 of the case for providing clearance for the circuit breaker operating components. The raised cradle pivot 8 and cradle pedestal wall 28 integrally formed above the terminal barrier 29 are similar to that described within the aforementioned U.S. patent. The cover 33 shown in FIG. 2 is attached to the base by means of a plurality of screw or rivet openings 32 formed complimentary within both the cover and base. When the cover is attached to the base, the angled arc barrier 30A formed in the base cooperates with the angled arc barrier 30B formed in the cover to close off the arc vent channel 31A formed in the base and 31B formed in the cover respectively. The bottom rail 35 formed in the cover cooperates with and abuts the bottom rail 12 formed in the case to provide a closed bottom surface to the arc vent channels 31A, 31B. In a like manner, the load lug recess 37A in the base cooperates with a similar load lug recess 37B formed in the cover. A cradle guide 36 is formed in the cover to keep the contact blade 57 shown in FIG. 3 away from the cover for purposes which will be described below in greater detail. The cradle guide also serves to position and guide the cradle 55 shown in FIG. 3. The cradle pedestal 39 formed in the cover cooperates with the raised cradle pivot 8 and cradle pedestal wall 28 formed in the base to encompass the opening 34 formed at the circular end 52 of the cradle for pivotally mounting the cradle. A complimentary handle recess 15B formed in the cover cooperates with the recess 15A formed in the base to support the operating handle 40 seen by referring now to FIG. 3. When the circuit breaker components are first mounted in the circuit breaker case 10 to form the assembled breaker 9 the latch spring 41 cooperates with the calibration screw 45 for setting the trip characteristics of the trip unit 46 consisting of a magnet 47 and bimetal 50. The magnet operates on the armature 48 to move the latch 68 on the bottom 51 of the bimetal away from the cradle hook 69 upon sudden overcurrent conditions and by operation of the bimetal 50 and magnet hook extension 49 to move the latch away from the cradle upon long term conditions of overcurrent. The contact blade 57 moves along the angled arc barriers 30A, 30B to separate the movable contact from the fixed contact 59 by operation of the operating handle 40 as well as by operation of the trip unit 46. The line strap 53 provides a connection between the external circuit and the line terminal clip 54 to which the fixed contact 59 is attached. Clip 54 provides spring tension for connection with the external busway. The arc chute 60 in combination with the arc cavity 62 serves to quench the arc that occurs when the contacts become separated. External electrical connection is made with the load terminal lug 42 and load terminal screw 43. The current then flows through load strap 44, conductor braid 61 and bimetal 50 to the contact blade 57.

Figure 3:
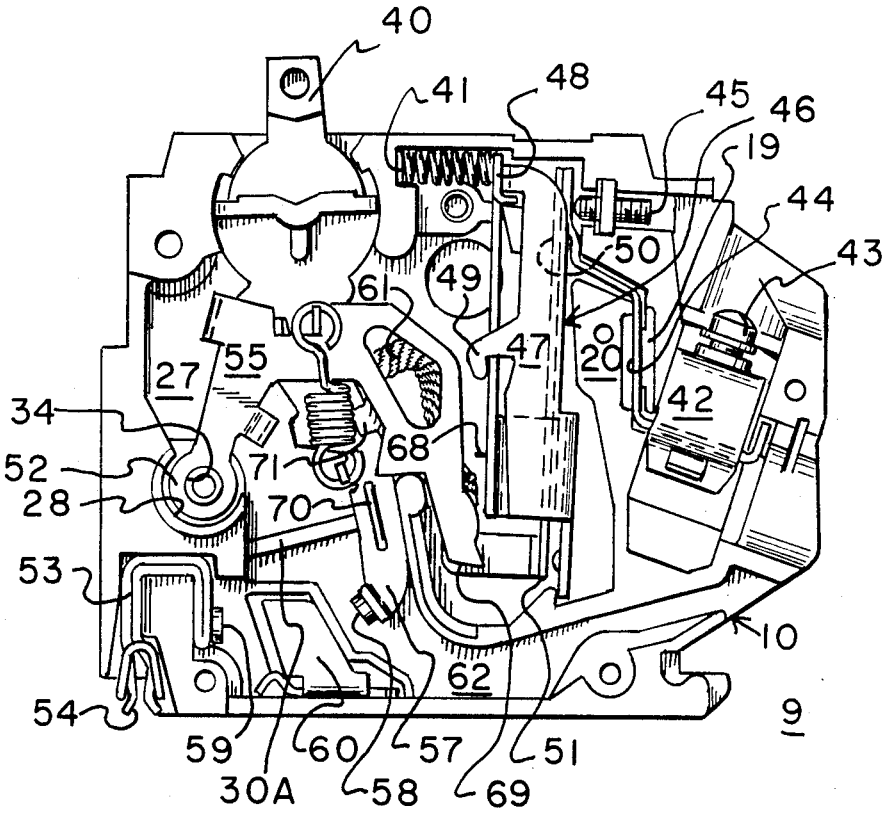
FIG. 3 is a plan view of the base depicted in FIG. 1 with the circuit breaker components mounted therein.
Figure 4:
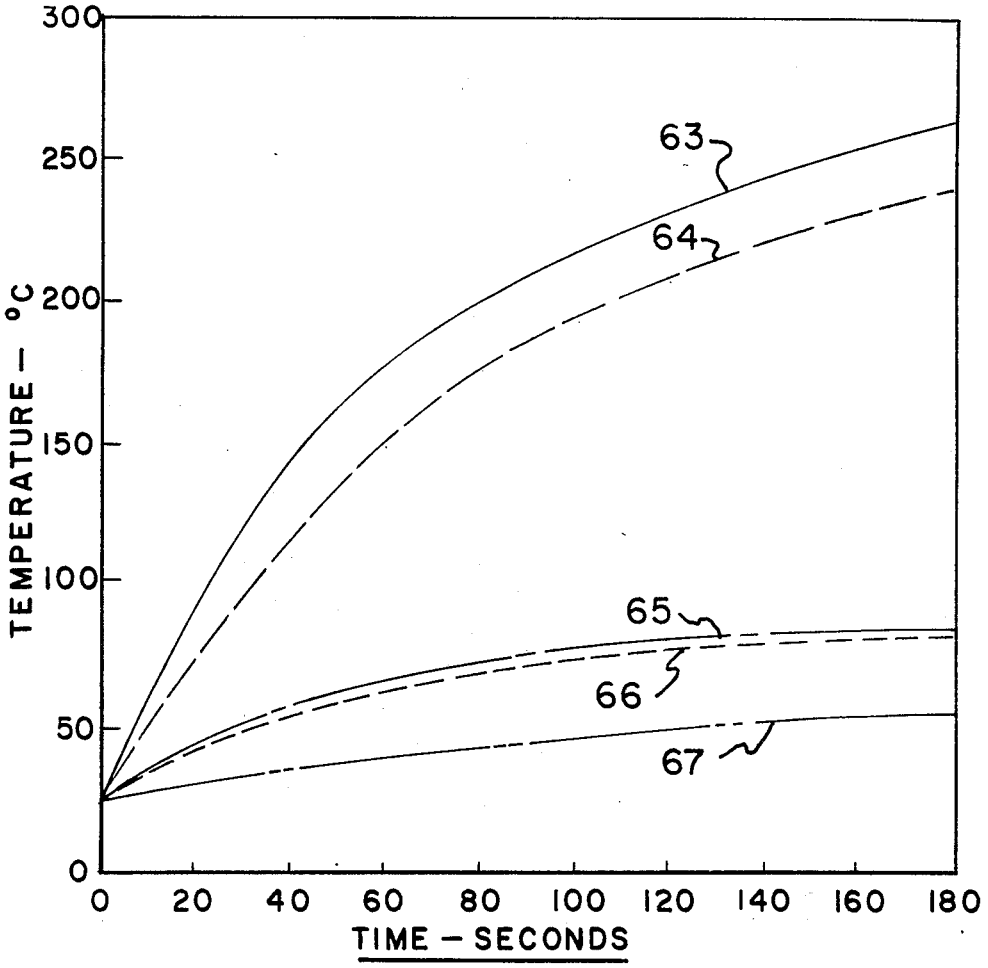
FIG. 4 is a thermal profile of some of the circuit breaker components as a function of time for a two hundred percent overload current through the breaker.

In determining the thermal characteristics of the assembled breaker 9 with the cover in place, the temperature of several of the operating components was measured as a function of time for 200% rated current. Thermocouple temperature sensors were attached at various locations and the temperature was monitored as a function of time. The temperature gradient for the bimetal 50, shown at 63 in FIG. 4 indicates that the bimetal is the hottest single component within the assembled breaker. This is because the bimetal intentionally becomes heated in proportion to the amount of current through the bimetal and is calibrated for tripping the breaker when a pre-determined overcurrent condition persists for a pre-determined period of time. The temperature gradient for the conductor braid shown at 64 indicates that the braid is the next hottest breaker component. The braid electrically connects between the bimetal and the contact blade 57 and the copper braid material is an excellent conductor of heat as well as of electricity. The next hottest component is the contact blade 57 as indicated at 65 because of the direct electrical connection with the conductor braid. The provision of the aforementioned angled arc barriers 30A, 30B serves to guide and align the contact blade as well as to provide a thermal heat sink for any heat generated by the bimetal and conducted along the conductor braid to the contact blade. The proximity of the magnet 47 to the bimetal 50 causes the magnet to assume the gradient depicted at 66. A thermocouple sensor attached to the interior surface of the cover 33 opposite the contact blade 57 measured the thermal gradient depicted at 67. A comparison was made between a standard Q-line circuit breaker, such as described within U.S. Pat. 3,464,040 to David B. Powell, to determine the difference in temperature obtained by means of the subject breaker design. Measurements were made on the interior cover and base of both breakers opposite the bimetal near the center of the cover and of the base. The standard Q-line circuit breaker cover interior measured 98° C. compared to 80° C. for the cover interior of the subject breaker design and measured 95° C. on the base interior of the standard Q-line breaker opposite the bimetal near the center of the base compared to 76° C. for the base interior of the subject breaker design. Both of the breakers were 20A rated and were subjected to 135% rated current to determine the maximum continuous steady state temperature the breakers would generate during service. It was thereby determined from a close inspection of the thermal characteristics of the breaker components that a thermoplastic-type material could be used to fabricate the molded cover 33. This was not possible with the standard Q-line circuit breaker because the operating temperature at 135% rated current is close to the heat deflection temperature of most thermoplastic resins. The use of thermoplastic material is desirable since the thermoplastic materials can be reheated and reused thereby substantially eliminating any waste products formed during the molding operation. A good thermoplastic material for the cover is a polyester comprising polybutylene terepthalate (PBT) sold under the trade name "Valox ®" which is a registered trademark of General Electric Company. Other thermoplastic materials having a heat deflection temperature in excess of 100° C. such as polycarbonates, polyamides, polyimides, polypropylenes, polyetherimides and polyphenylene oxide-based polymers, could also be used. Mixtures of thermoplastic resins, such as acrylonitrile butadiene styrene, for example can present useful higher heat deflection temperatures than the components within the mix and are too numerous to list herein. The low thermal gradient measured at the cover was achieved by the placement of the current carrying components, such as the bimetal 50 and the conductor braid 61 away from the cover as shown in FIG. 3. The braid 61 is positioned proximate the bottom 27 of the case such that the cradle 55 interfaces between the cover and braid and serves as an effective heat shield. The positioning of the load strap 44 between the right and left barriers 19, 20 allows the heat transferred from the bimetal 50 by attachment therewith to transfer to within these barriers as "heat sinks" and become dissipated within the case. It is noted that contact is made between the contact blade 57 and the cover by abutment of the raised ribbed region 70 on the contact blade with the angled arc barrier 30B integrally formed within the cover. The contact blade at this point is far enough removed from the point of contact of the contact blade with the conductor braid 61, at weld 71, that any heat remaining between the weld 71 and the movable contact 58 is distributed between the angled arc barrier 30A on case 10 and with the angled arc barrier 30B on the cover 33 to result in the low thermal gradient 67 described earlier with reference to FIG. 4.

It has therefore been determined that by employing a thermoset plastic material such as a 45% glass-filled polyester, and arranging the "hot" current carrying components away from the cover, that the good heat sinking properties of the thermoset polyester case can effectively heat sink the thermal energy generated by overcurrent conditions through the breaker without causing any distortion of the components that set the trip unit calibration. This now allows for a lower temperature plastic material of the thermoplastic polyester-type to be used for the cover without any danger of thermal distortion thereof.

Having described our invention, what we claim as new and desire to secure by Letters Patent is:

1. An electric circuit breaker comprising:

a molded thermoplastic plastic cover having a first angled arc barrier and a contact blade guide extending perpendicular from a bottom surface;

a molded thermoset plastic case having a complementary second angled arc barrier extending from a bottom surface for abutting said first arc barrier, to define a contact blade slot;

first and second barriers defining a load strap slot integrally formed within said case bottom surface for receiving a load strap in pressfit relation to said slot, said load strap being connected with a magnetic trip unit and a bimetal;

a contact blade pivotally mounted on said base within said contact blade slot and electrically connecting between a movable contact at one end and a fixed contact within said case;

a contact braid connecting an end of said contact blade opposite said movable contact with said bimetal; and a cradle pivotally mounted on said base for latchably connecting a hooked end with said trip unit, said cradle being arranged intermediate said thermoplastic cover and said contact braid for heat shielding said thermoplastic cover from said contact braid.

2. The improved electric circuit breaker of claim 1 wherein said molded cover is selected from the group of thermoplastics consisting of polycarbonate, polyimide, polyamide, polypropylene, polyetherimide and polyphenylene oxide resins.

3. The improved electric circuit breaker of claim 1 wherein said thermoplastic plastic has a heat deflection temperature in excess of 100° C. and said thermoset plastic has a heat deflection temperature in excess of 200° C.

4. The improved electric circuit breaker of claim 1 wherein said thermoplastic plastic comprises polybutylene terephthalate or polyethylene terephthalate

5. The improved electric circuit breaker of claim 1 wherein said thermoplastic plastic comprises glass-filled polyester.

6. The circuit breaker of claim 1 wherein said cradle is pivotally mounted opposite said hooked end on a pivot pin integrally formed within said thermoset plastic case.

7. The circuit breaker of claim 1 wherein said thermoplastic plastic cover is molded from a material having a heat deflection temperature in excess of 100° C. and said thermoset plastic case is molded from a material having a deflection temperature in excess of 200° C.

* * * * *